US005260723A

United States Patent [19]

Naruse et al.

[11] Patent Number: 5,260,723

[45] Date of Patent: Nov. 9, 1993

[54] LIQUID JET RECORDING HEAD

[75] Inventors: Osamu Naruse; Minoru Ameyama; Syuzo Matsumoto; Hiromichi Komai, all of Kanagawa; Tositaka Hirata, Tokyo, all of Japan

[73] Assignee: Ricoh Company, Ltd., Tokyo, Japan

[21] Appl. No.: 522,328

[22] Filed: May 11, 1990

[30] Foreign Application Priority Data

| | | | |
|---|---|---|---|
| May 12, 1989 | [JP] | Japan | 1-119299 |
| May 30, 1989 | [JP] | Japan | 1-138503 |
| Mar. 16, 1990 | [JP] | Japan | 2-67436 |

[51] Int. Cl.[5] ..... B41J 2/045; B41J 2/055

[52] U.S. Cl. ..... 346/140 R

[58] Field of Search ..... 346/140 PD, 75; 310/365, 366

[56] References Cited

U.S. PATENT DOCUMENTS

| | | | |
|---|---|---|---|
| 4,072,959 | 2/1978 | Elmqvist | 346/140 R |
| 4,124,853 | 11/1978 | Kattner et al. | 346/140 R |
| 4,385,304 | 5/1983 | Sniderman | 346/140 R |
| 4,390,886 | 6/1983 | Sultan | 346/140 R |
| 4,418,354 | 11/1983 | Perduijn | 346/140 R |
| 4,511,598 | 4/1985 | Creagh | 346/140 R X |
| 4,523,121 | 6/1985 | Takahashi et al. | 310/334 |
| 4,752,789 | 6/1988 | Maltsev | 346/140 R |
| 4,819,014 | 4/1989 | Yasuhara et al. | 346/140 R |
| 4,875,059 | 10/1989 | Masuda | 346/140 R |
| 4,879,568 | 11/1989 | Bartky et al. | 346/140 R |
| 4,937,597 | 6/1990 | Yasuhara et al. | 346/140 R |
| 4,978,881 | 12/1990 | Watika et al. | 310/366 X |

FOREIGN PATENT DOCUMENTS

| | | | |
|---|---|---|---|
| 59-12859 | 1/1984 | Japan . | |
| 159358 | 9/1984 | Japan . | |
| 0199255 | 11/1984 | Japan | 346/140 PD |
| 90770 | 5/1985 | Japan . | |
| 56150 | 3/1987 | Japan . | |
| 252750 | 10/1988 | Japan . | |
| 1-226186 | 9/1989 | Japan . | |

OTHER PUBLICATIONS

"IMC 1986 Proceedings, Kobe, May 28-30, 1986" Designed-space Forming Technology in Ceramics; Kazuaki Utsumi, et al., pp. 36-42.

*Primary Examiner*—Benjamin R. Fuller
*Assistant Examiner*—Alrick Bobb
*Attorney, Agent, or Firm*—Cooper & Dunham

[57] ABSTRACT

A liquid jet recording head includes a flow path member having a plurality of flow paths, each of the plurality of flow paths having an opening surface which opens on the flow path member, an piezo-electric member having a plurality of grooves and piezo-electric elements, each of the piezo-electric elements being formed between adjacent two grooves of the plurality of grooves, the piezo-electric member being connected to the flow path member so that each of the piezo-electric elements is faced to the opening of one of the plurality of flow paths, an elasticity member being filled in each of the plurality of grooves formed on the piezo-electric member, a liquid guide mechanism guiding, to each of the plurality of flow paths, liquid which is supplied by an external liquid supplying mechanism, and jet orifices, each of the jet orifices being provided to an end portion of one of the plurality of flow paths.

21 Claims, 10 Drawing Sheets

LIQUID JET RECORDING HEAD

BACKGROUND OF THE INVENTION

The present invention generally relates to a liquid jet recording head, and more particularly to a liquid jet recording head in which liquid drops are jetted through orifices by using vibration of piezo-electric elements.

A liquid jet recording apparatus, such as a conventional on-demand-type ink jet recording apparatus, has a piezo-electric actuator. It is difficult to increase integration density of the conventional recording head. Even if an integration density is increased a driving voltage of the piezo-electric actuator must be also increased.

The following documents disclose recording heads directed to improving the disadvantage described above.

Japanese Patent Publication No. 60-8953 discloses a recording head in which a piezo-electric actuator is provided in ink and opposed to a nozzle, ink drops are jetted from the nozzle due to driving of the piezo-electric. In Japanese Laid-Open Patent Application No. 63-252750, a recording head is disclosed in which the piezo-electric actuator drives partition walls of a flow path having ink and so ink drops are jetted from the flow path. In Japanese Laid-Open Patent Application No. 59-159358, a recording head is proposed in which walls of the flow path having ink are formed on piezo-electric blocks. Then, due to vibrations of the piezo-electric blocks, ink is jetted from the flow path. In a recording head disclosed in Japanese Laid-Open Patent Application No. 62-56150, grooves which are arranged in parallel with each other are formed as flow paths of ink on a piezo-electric plate. U.S. Pat. No. 4,072,959 discloses a recording head in which a pusher pin is provided adjacent to an orifice and ink which exists near the orifice is jetted through the orifice due to a bending displacement of the pusher pin. In addition, in "IMC 1986 Proceeding Kobe." (May 28–30 1986), a recording head having a piezo-electric member is disclosed. The piezo-electric member has layered green sheets. A cavity portion is provide in the layered green sheets. Ink drop is jetted from the cavity portion, when a displacement in the piezo-electric member is produced due to a bending moment of the piezo-electric member.

Japanese Laid-Open Patent Application No. 60-90770 disclosed a recording head as shown in FIG. 1. In FIG. 1, grooves 11 are formed in a parallel form with each other on a piezo-electric plate 1. Thus, in the piezo-electric plate 1, a piezo-electric element (hereinafter simply referred to as element) 1*a* is formed between two of the grooves 11. Each of the elements 1*a* can vibrate independently. A flow path plate 2 has a plurality of flow paths 9 which are arranged in parallel with each other. Each of the flow paths 9 is a groove formed on the flow path plate 2, and ink is supplied to the groove (i.e. the flow path) from an external ink supplier (not shown in FIG. 1). A vibration plate 12 is sandwiched between the piezo-electric plate 1 and the flow path plate 2 so that an end of each element 1*a* opposes to one of the flow path 9.

Vibration of each of the elements 1*a* is transmitted via the vibration plate 12 to ink in the corresponding flow path 9 so that ink drops are jetted from the flow path 9 through an orifice (not shown in FIG. 1).

In the conventional recording head as is shown in FIG. 1, it is possible to increase integration density, since a plurality of the vibration elements 1*a*, each being a driving source to jet ink drops, are formed by forming of a plurality of grooves 11 on the piezo-electric plate 1. Then, it is also easy to form vibration elements 1*a*.

However, there is the possibility of warping of the flow path plate 2, since a force which is caused by vibration of elements 1*a* adds via the vibration plate 12 to the whole surface of the flow path plate 2, which contacts with the vibration plate 12.

In addition, the vibration of each of the elements 1*a* transmits via the vibration plate 12 to the corresponding flow path 9 so that it is difficult to obtain sufficient changing of the volume in the flow path 9. Thus, it is necessary to increase the driving voltage of the piezo-electric plate 1.

SUMMARY OF THE INVENTION

Accordingly, a general object of the present invention is to provide a novel and useful recording head in a liquid jet recording apparatus, in which the disadvantage of the aforementioned prior art are eliminated.

A more specific object of the present invention is to provide a liquid jet recording head capable of operation without warping of the flow path plate.

The above objects of the present invention are achieved by a liquid jet recording head in comprising a flow path member having a plurality of flow paths which are arranged in parallel with each other, each of the plurality of flow paths being isolated from an adjacent flow path by a partition wall and having an opening surface which opens on the flow path member, an piezo-electric member having a plurality of grooves which are formed on the piezo-electric member and are arranged in parallel with each other, and piezo-electric elements, each of the piezo-electric elements being formed between two adjacent grooves of the plurality of grooves and having a width which is less than or equal to a width of said opening surface of each of the plurality of flow paths, the piezo-electric member being connected to the flow path member so that each of the piezo-electric elements is faced to one of the plurality of flow paths, an elasticity member being filled in each of the plurality of grooves formed on the piezo-electric member, a liquid guide mechanism guiding, to each of the plurality of flow paths, liquid which is supplied by an external liquid supplying mechanism, and jet orifices, each of the jet orifices being provided to an end portion of one of the plurality of flow paths, wherein liquid in each of the plurality of flow paths is jetted, as a liquid drop, through each of the jet orifices due to a vibration of each of the piezo-electric elements in a direction perpendicular to said plurality of flow paths.

Another object of the present invention is to provide to a liquid jet recording head so that it is possible to obtain a sufficient changing of the volume in the flow path having liquid such as ink by the ordinary vibration of the piezo-electric element.

This object of the present invention is achieved by a liquid jet recording head comprising a flow path member having a plurality of flow paths which are parallel to each other, each of the plurality of flow paths being isolated from an adjacent flow path by a partition wall and having an opening surface which opens on the flow path member, the partition wall having an elasticity member, an piezo-electric member having a plurality of piezo-electric elements which are arranged in parallel with each other, each of the piezo-electric elements having a width which is greater than a width of the opening surface of each of the plurality of flow paths, the piezo-electric member being connected to the flow path member so that each of the piezo-electric elements is faced to one of the plurality of flow paths, liquid guide mechanism guiding, to each of the plurality of flow paths, liquid which is supplied by an external liquid supplying mechanism, and jet orifices, each of the jet orifices being provided to an end portion of one of the plurality of flow paths, wherein liquid in each of the plurality of flow paths is jetted, as a liquid drop, through each of the jet orifices due to a vibration of each of the piezo-electric elements in the perpendicular direction to each of the plurality of flow paths.

Additional objects, features and advantages of the present invention will be become apparent from the following detailed description when read in conjunction with the accompanying drawings.

BRIEF DESCRIPTION OF THE DRAWINGS

FIG. 8 is a cross-sectional view showing the first embodiment of the liquid jet recording head according to the present invention;

DESCRIPTION OF THE PREFERRED EMBODIMENTS

A description will now be given of a first preferred embodiment of the present invention with reference to FIG. 2A through FIG. 5.

Figure 2A:
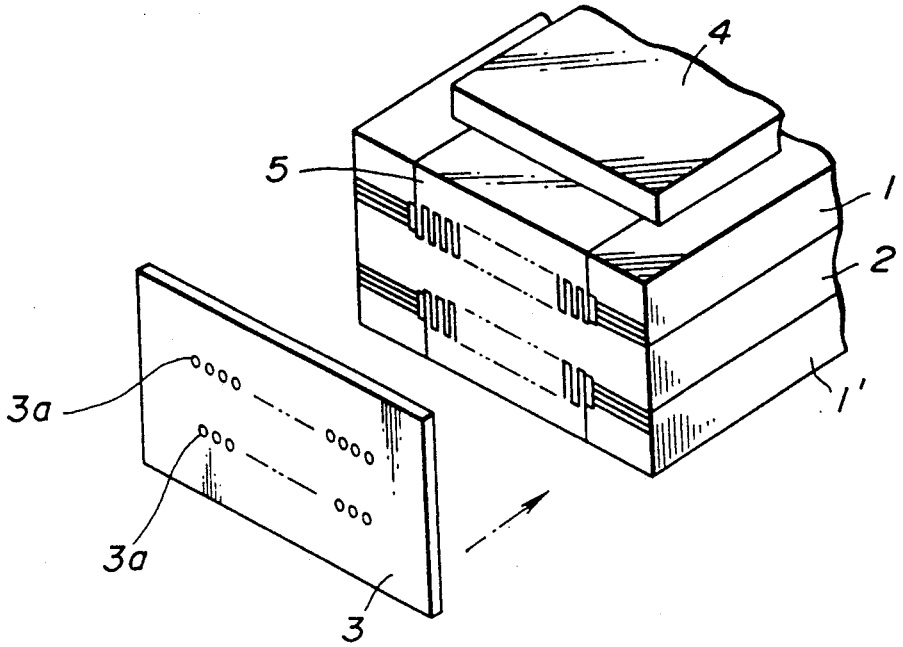
FIGS. 2A and 2B show a structure of a first embodiment of the liquid jet recording head according to the present invention.
Figure 2B:
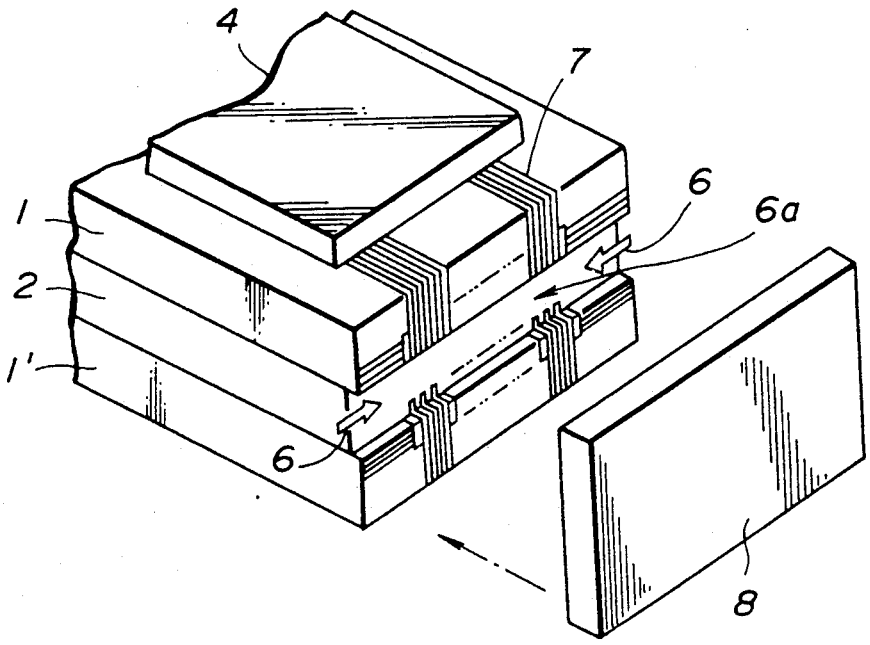

The front side structure of the recording head is shown in FIG. 2A. The rear side structure of the recording head is shown in FIG. 2B.

The recording head has two piezo-electric plates 1 and 1', a flow path plate 2, a nozzle plate 3, a driver IC unit 4, and a back plate 8. The flow path plate 2 is sandwiched between the piezo-electric plates 1 and 1'. Each of these piezo-electric plates 1 and 1' is a layer-type piezo-electric plate. The front surface of the recording head in which the piezo-electric plates 1 and 1' and the flow path plate 2 are integrated is provided with the nozzle plate 3. In the rear side of the recording head, a groove is formed of end portions of piezo-electric plates 1 and 1' and the flow path plate 2, and the back plate 8 is connected to the rear end surface of each of the piezo-electric plates 1 and 1' so that a common path 6*a* having ink inflow openings 6 at the both ends of it is formed.

Figure 1:
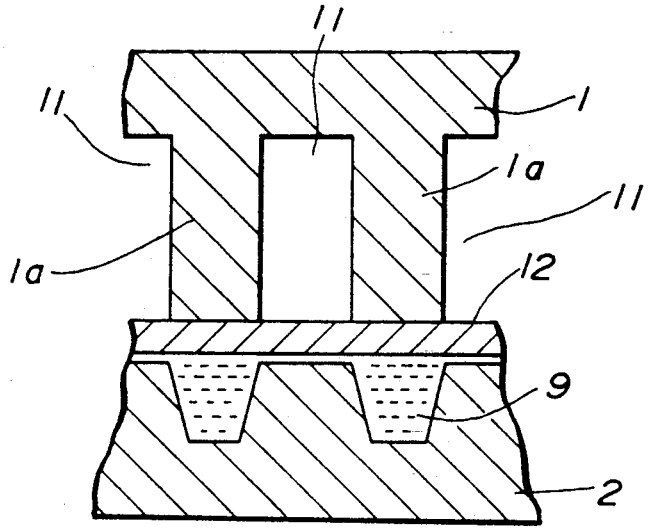
FIG. 1 PRIOR ART
FIG. 1 is a cross-sectional view of a conventional liquid jet recording head.
Figure 3:
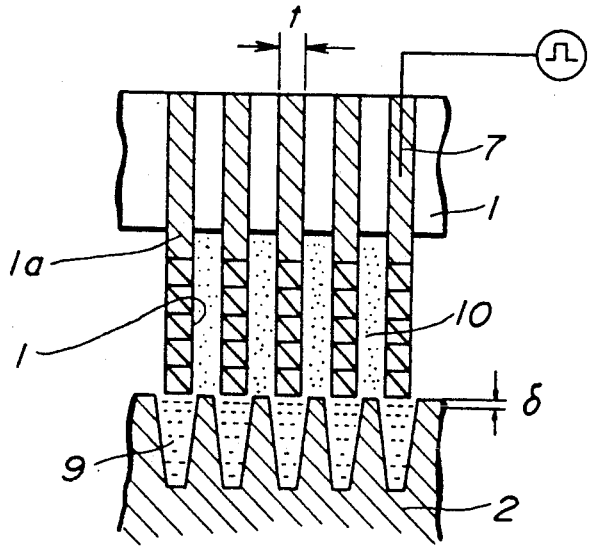

On a surface of each of the piezo-electric plates 1 and 1' and which contacts with the flow path plate 2, a plurality of grooves 1*b* are formed in parallel with each other as is shown in FIG. 3. Thus, a piezo-electric element 1*a* is formed between each two of the grooves 1*b*. The piezo-electric plate 1 has a common electrode 5, and each of piezo-electric elements 1*a* has an independent electrode provided on the end surface of it. Then, each piezo-electric elements 1*a* vibrates in a direction of its thickness ($d_{33}$ direction) independently. On each surfaces of the flow path plate 2 and which contacts with one of the piezo-electric plate 1, grooves, as flow paths 9, are formed in parallel with each other so that an opening of each of the flow paths 9 opposes to one of the piezo-electric element 1*a*. Then, a width of each of the piezo-electric element 1*a* is less than or equal to a width of the opening of the corresponding flow path 9. In each of the grooves 1*b* between adjacent piezo-electric elements 1*a*, a filler 10 is provided. The flow paths 9 continue from the front end of the flow path plate 2 to the rear end of it. Then, each of the flow paths 9 is connected to the common path 6*a*. An external ink supplier mechanism (not shown in figures) supplies ink through the ink inflow openings 6 to the common path 6*a*. Furthermore, the ink is supplied to each of flow paths 9 from the common path 6*a*. On the other hand, orifices 3*a* are formed in the nozzle plate 3. Each of the orifices 3*a* is corresponding to one of the flow paths 9.

Each of the flow paths 9 formed on the piezo-electric plate 1 is opposite to a portion which is sandwiched by the adjacent two of the flow paths 9 formed on the other piezo-electric plate 1'. Thus, a dot density of the recording head is increased.

The driver IC unit 4 is mounted on each of the piezo-electric plates 1 and 1' and so the recording head is miniaturized. At the front side of the recording head, the common electrode 5 of the piezo-electric plate 1 (1') is electrically connected with the driver IC unit 4. At the rear side of the recording head, each of the independent electrodes of the piezo-electric elements 1*a* is electrically connected with the driver IC unit 4 through the signal lines 7. The driver IC unit 4, for example, can be connected to the signal lines 7 by a chip-flow method. The driver IC unit 4 directly contacts with the piezo-electric plate 1(1') so that the heat of the driver IC 4 unit is efficiently radiated.

A controller (not shown in figures) selectively supplies electrical signals corresponding to image information to the piezo-electric elements 1*a*. When the piezo-electric element receives the electrical signal, the piezo-electric element extends and contracts in the direction of its thickness and so in the corresponding flow path 9, the volume changes by "Q". Then, an ink drop which is caused by changing of the volume is jetted through the corresponding orifice 3*a* of the nozzle plate 3. An amount of the "Q" is expressed as follows.

$$Q = t \times \delta \times L$$

$$\delta = n \times d_{33} \times V_p$$

t: width of the piezo-electric element

δ: an amount of the change at a time of applying voltage ($V_p$ volts)

$d_{33}$: piezo-electric constant in a direction of the thickness of the element n: the number of the layers in the element L: effective operation length of the element According to above formulas, if the voltage $V_p$ is only decreased in order to drive the piezo-electric element by low voltage, the number "n" of layers in the element and/or the effective operation length "L" of the element must be increased. However, if the number "n" of layers in the element is merely increased, it becomes difficult to form the grooves 1*b* on the piezo-electric plate 1. If the effective operation length "L" of the element is merely increased, the recording head itself becomes large and a compliance of each of the piezo-electric elements 1*a* becomes large so that a response characteristic of each of them deteriorates. Thus, each of parameters (t, δ, $d_{33}$, n, L) is optimized so that it is possible to drive the piezo-electric element 1*a* by low voltage which can be supplied from the drive IC unit 4.

Each of the piezo-electric elements 1*a* operates only on the corresponding flow path 9 so that there is no influence of each of the piezo-electric elements 1*a* in the other flow path 9 adjacent to the corresponding flow path 9. Then, it is possible to operate each of the flow paths 9 and to increase an effective frequency of ink jet operation.

When the piezo-electric element 1*a* expands, an internal pressure in the corresponding flow path 9 increases so that a force caused by the internal pressure is exerted on the piezo-electric element 1*a*. However, a surface of the piezo-electric element 1*a* and on which the force is exerted is very small and so the operation efficiency of the piezo-electric element 1*a* does not decrease if the density of the piezo-electric elements 1*a* increases.

Figure 4:
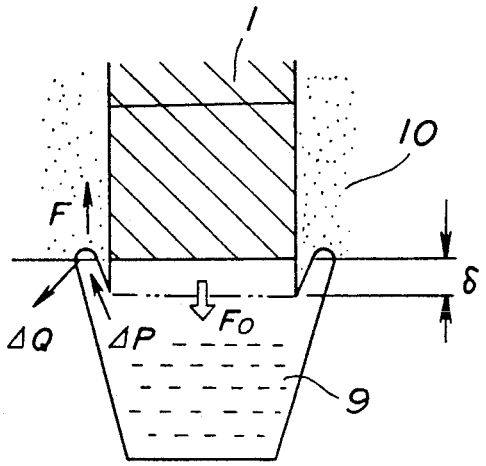
FIG. 4 is a cross-sectional view on an enlarged scale showing an essential part of the liquid jet recording head according to the present invention.

FIG. 4 is a grossly enlarged sectional view of the portion where the piezo-electric element 1*a* is connected to the flow path 9.

When the voltage V, is added to the piezo-electric element 1*a* and the piezo-electric element 1*a* expands by δ, a first force "F" as a reaction from the filler 10 and a second force "ΔP" caused by the increasing of the internal pressure in the flow path 9 are exerted on the piezo-electric element 1*a* so that an expansion of the piezo-electric element 1*a* is prevented. The second force "ΔP" caused by the increasing of the internal pressure is negligibly small compared to a force "$F_o$" which is produced by the piezo-electric element 1*a*. In addition, due to the increasing of the internal pressure in the flow path 9, the shape of the filler 10 changes so that cavity of the flow path 9 increases by "ΔQ". The first force "F" described above operates as a shearing force between the piezo-electric element 1*a* and the filler 10. When the modulus of elasticity of the filler 10 is large, it is difficult that the piezo-electric element 1*a* expands and contracts, and the displacement of the piezo-electric element 1*a*. On the other hand, when the modulus of elasticity of the filler 10 is small, the shape of the filler 10 changes by "ΔQ" as has been described above. The optimum values of these forces are determined according to quality (the modulus of elasticity) and size of the filler 10 and the like, that is, they are not uniquely determined. Material of the filler 10 is experimentally determined. According to the experiment, it was found that rubber materials such as silicon, polybutadien and soft epoxy materials are suited for the filler 10 in that such materials show superior flexibility, water-resistant and easy bonding characteristics.

Figure 5:
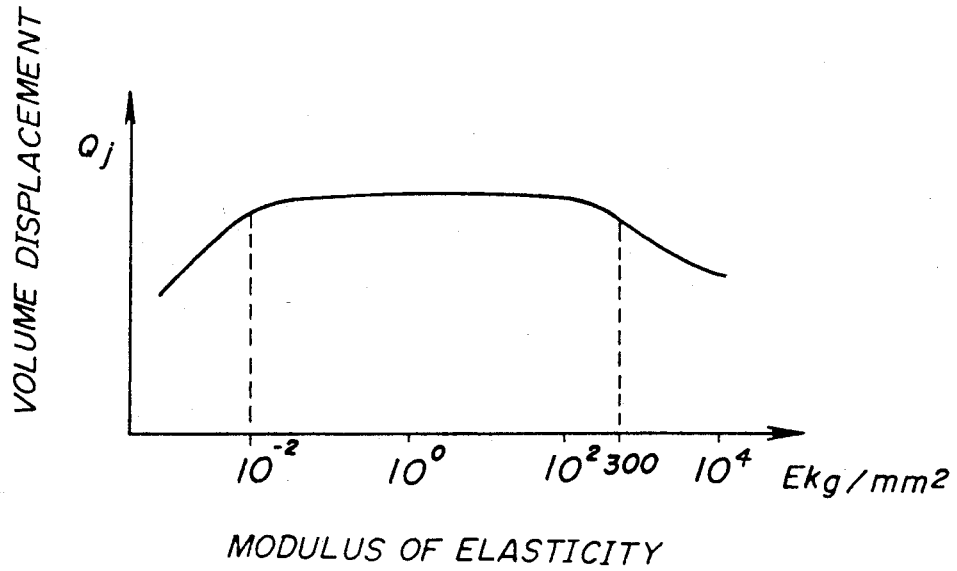
FIG. 5 is a graph showing a relationship between a modulus of elasticity of a filler and a volume displacement of a flow path.

FIG. 5 shows a relationship between the modulus of elasticity of the filler 10 and the volume displacement of the flow path 9. This relationship was experimentally obtained. As is shown in FIG. 4, the volume displacement of the flow path 9 is large when the modulus of elasticity of the filler 10 varies between 0.01 kg/mm$^2$ and 300 kg/mm$^2$.

Figure 6:
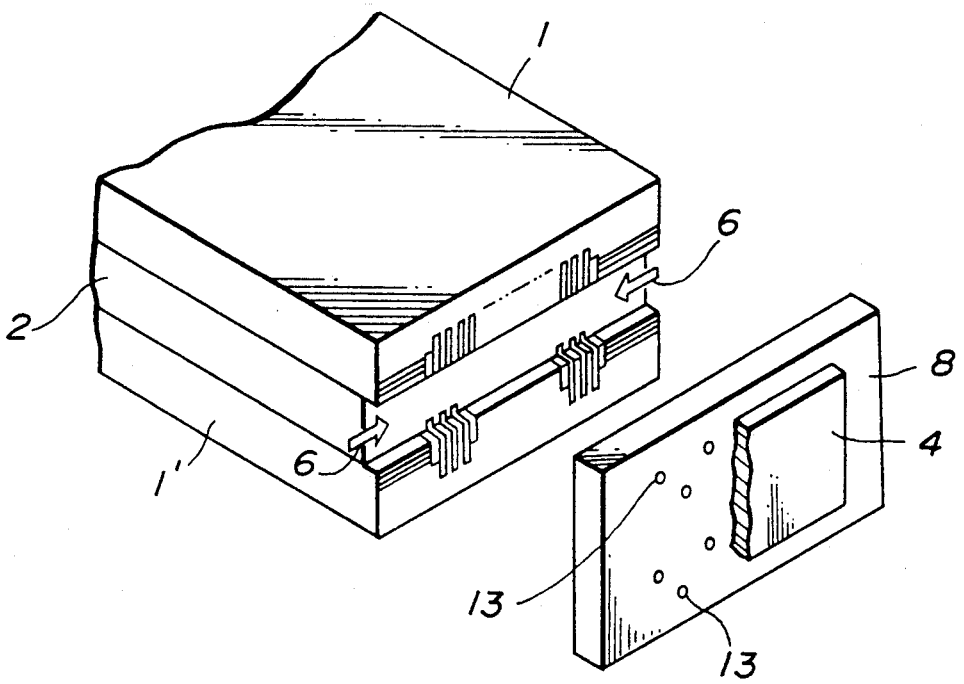
FIG. 6 shows a modification of the recording head of the present invention.

FIG. 6 shows a modification of the recording head in which the flow path plate 2 is sandwiched between two layer-type piezo-electric plates 1 and 1'. In FIG. 6, the back plate 8 is provided with the driver IC unit 4. The driver IC unit 4 is electrically connected to the electrode of each of the piezo-electric elements in the piezo-electric plates 1 and 1' by signal lines (not shown in FIG. 6) through holes 13 formed in the back plate 8. The back plate 8 is formed of ceramic materials so that the back plate 8 shows superior corrosion resistance and operates as a radiator base plate of the driver IC unit 4. In addition, the driver IC unit 4 includes two drive circuits for the piezo-electric plates 1 and 1'. Then, it is advantageous for signal operation that the two drive circuits are integrated in one body.

Figure 7A:
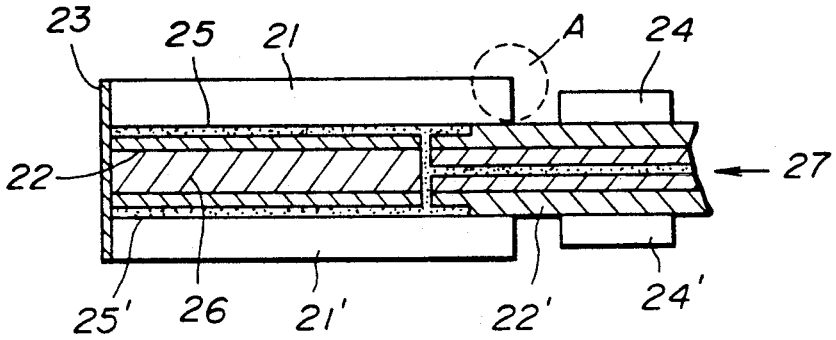
FIGS. 7A and 7B shows another modification of the present invention.
Figure 7B:
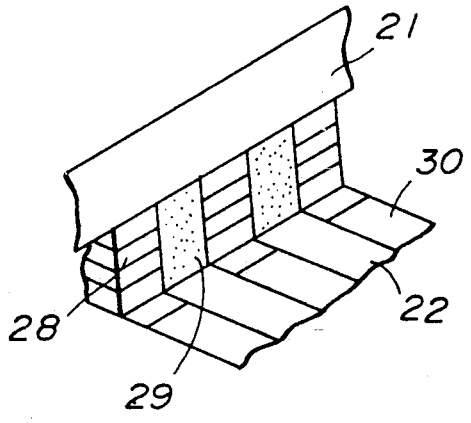

A description will now be given of another modification of the recording head according to the present invention with reference to FIGS. 7A and 7B. FIG. 7A is a cross-sectional view and FIG. 7B is an enlarged detail view of a portion A in FIG. 7A.

In FIG. 7A, a flow path plate 22 is provided on an upper surface of a base plate 26 and another flow path plate 22' is provided on a lower surface of it. Each of the flow path plates 22 and 22' has a plurality of flow path 25(25') as is shown in FIG. 3. A piezo-electric plate 21 is provided on the flow path plate 22 and another piezo-electric plate 21' is provided on the flow path plate 22'. Each of the piezo-electric plate 21 (21') has a plurality of piezo-electric elements and each of the piezo-electric elements corresponds to one of the flow path as is shown in FIG. 3. A filler 29 is provided in a groove formed between the adjacent two piezo-electric elements 28 as is shown in FIG. 7B. A nozzle plate 23 is provided on the front end surface of the recording head having the base plate 26, piezo-electric plates 21 and 21' and flow path plates 25 and 25'. Ink from the external ink supplier is supplied though inside of the base plate 26 to each of the flow paths 25 and 25'. Ink flows into the flow path 25 through a lower surface of the flow path plate 22 and flows into the flow path 25' through an upper surface of the flow path plate 22'. As is shown in FIG. 7B, patterned signal lines 30 are formed on the flow path plate 22 and behind the piezo-electric plate 21, and each of the patterned signal line 30 is electrically connected to a independent electrode of one of the piezo-electric elements 28. Then, A driver IC unit 24 is bonded on the flow path plate 22 and is directly connected to the patterned signal lines 30. Another driver IC unit 24' is provided on the flow path plate 22' as in the same case of the driver IC unit 24 and is electrically connected to a independent electrode of each of the piezo-electric elements in the same manner as in FIG. 7B. Each of the flow path plate 22 and 22' is made of material such as photo-sensitive glass, silicon wafer and the like so that it is easy to form grooves as the flow paths by using half etching method and to form patterned signal line by using spattering method.

Figure 8A:
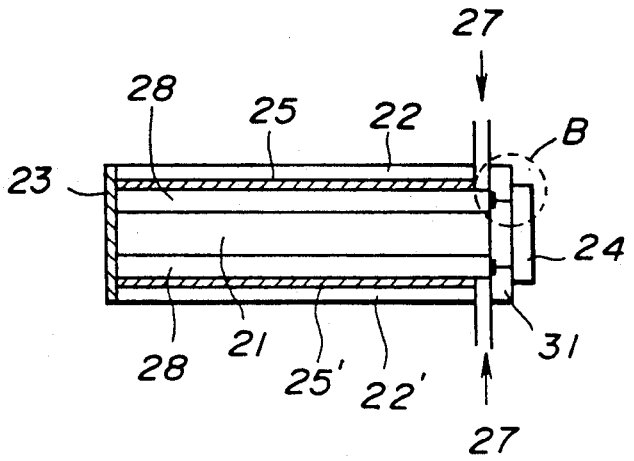
FIGS. 8A and 8B shows a further modification of the recording head of the present invention.
Figure 8B:
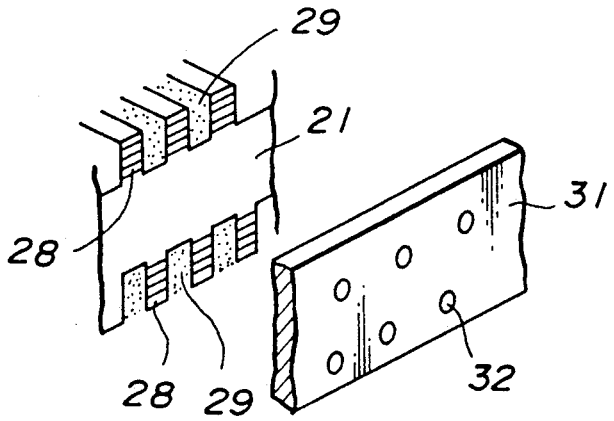

A description will now be given of another modification of the recording head according to the present invention with reference to FIGS. 8A and 8B. FIG. 8A is a cross-sectional view and FIG. 8B is an enlarged detail view of a portion B in FIG. 8A. In FIGS. 8A and 8B, those parts which are the same as those shown in FIGS. 7A and 7B are given the same reference numbers.

As is shown in FIG. 8B, the grooves are formed on each of both surfaces of the piezo-electric plate 21 so that the piezo-electric elements 28 are formed between two of the grooves. Each of the grooves is filled with the filler 29. Each of the piezo-electric elements 28 on a surface (upper surface in FIG. 8B) of the piezo-electric plate 21 opposes to one of the grooves on a opposite surface (lower surface in FIG. 8B) thereof. The flow path plate 22 is provided on the upper surface of the piezo-electric plate 21 and the other flow path plate 22' is provided on the lower surface of the piezo-electric plate 21 as is shown in FIG. 8A.

In the recording head having a structure described above, the piezo-electric elements 28 are formed on the both surfaces of the piezo-electric plate 21 and a thickness of the piezo-electric plate 21 is large. Thus, stiffness of the piezo-electric plate is large. On the both surfaces of the piezo-electric plate 21, vibrations of the piezo-electric elements 28 are generated and so the piezo-electric plate 21 bends a little. The front end of the recording head is provided with the nozzle plate 23 and the rear end thereof is provided with a back plate 31. Holes 32 are formed in the back plate 31 and each of the piezo-electric elements 28 is electrically directly connected through the hole 32 to the driver IC unit (not shown in FIG. 8B). Thus, the recording head improves in electrical reliability.

A description will now be given of a second preferred embodiment of the present invention with respect to FIG. 9 through FIG. 12F.

Figure 9:
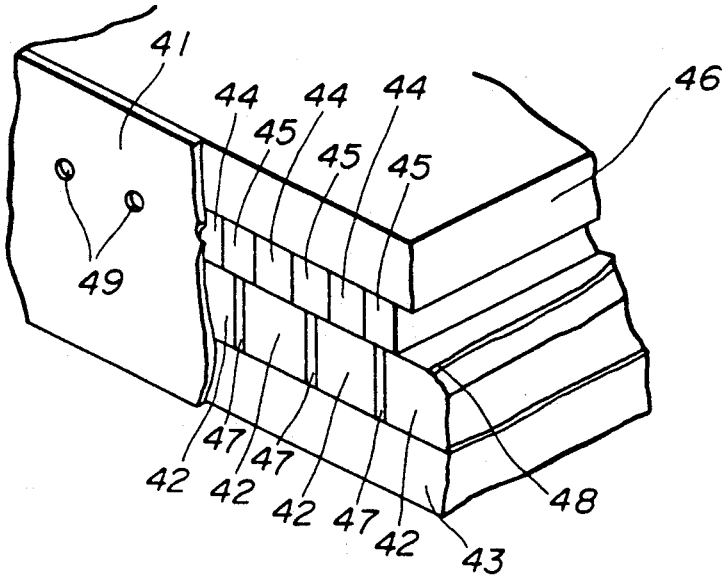
FIG. 9 is a partially cutaway perspective view showing a structure of a second embodiment of the liquid jet recording head according to the present invention.
Figure 10A:
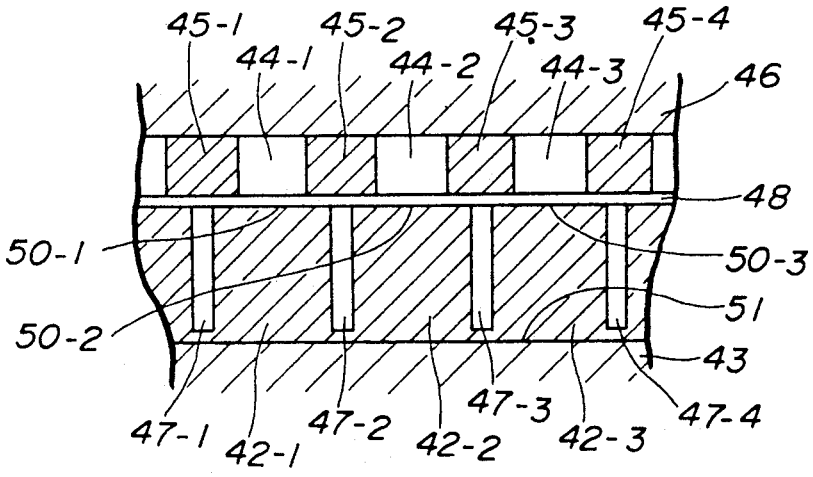
FIGS. 10A and 10B are cross-sectional views of the second embodiment of the liquid jet recording head according to the present invention.
Figure 10B:
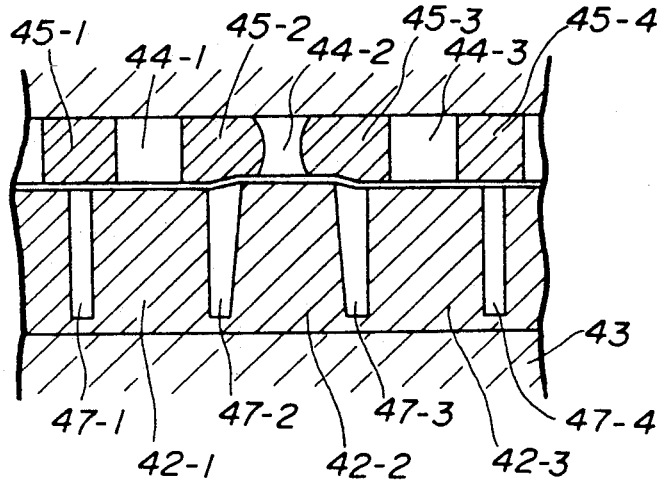

FIG. 9 is a perspective view of a front of the recording head and FIGS. 10A and 10B are cross-sectional views. A plurality of piezo-electric elements 42 are provided in parallel with each other on a base plate 43. A plurality of grooves 47 are formed on a piezo-electric plate so that the piezo-electric elements 42 are formed so as to be substantially isolated with each other by one of the grooves 47. A connection layer 48 is formed on the piezo-electric elements 42. A plurality of partition members 45 are provided on the connection layer 48 in parallel with each other. Each of the partition members 45 opposes to one of the grooves 47 and has a width which is larger than a width of each of the grooves 47. Each of the partition members 45 is made of an elasticity member in which Young's modulus is an arbitrary value between 100 kg f/mm$^2$ and 1000 kg f/mm$^2$. An upper plate 46 is connected to upper surfaces of the partition members 45 so that a flow path 44 is formed between adjacent two of the partition members 45. At a front end of the recording head having the base plate 43, the piezo-electric elements 42, the connection layer 48, the partition members 45 and the upper plate 46, a nozzle plate 49 having a plurality of orifices 49. Each of orifices 49 corresponds to one of the flow paths 44 formed between adjacent two of the partition members 45. Each of the flow paths 44 is connected to a common liquid chamber (not shown in FIG. 9) at a rear end of the recording head. Ink from an external ink supplier is supplied through the common liquid chamber to each of the flow paths 44.

A common electrode 51 is formed on a surface of the piezo-electric plate having the piezo-electric elements 42 and which is connected to the base plate 43. A drive electrode 50 is formed on a surface of each of the piezo-electric elements 42 and which is connected to the connection layer 48.

In FIGS. 10A and 10B, for example, when a predetermined voltage from a controller (not shown in FIGS. 10A and 10B) is applied between the common electrode 51 and the drive electrode 50-2, the piezo-electric element 42-2 is distorted so as to expand in a direction of a thickness thereof ($d_{33}$ direction) and to contract in a direction of a width thereof. Because, each of the piezo-electric elements 42 is polarized in the direction of the thickness thereof. Thus, a volume of the flow path 44-2 is directly decreased by the piezo-electric element 42-2 as is shown in FIG. 10B. In addition, each of a side portion of the partition member 45-2 and a side portion of the partition member 45-3, which is adjacent to the flow path 44-2, is pressed between the upper plate 46 and the piezo-electric element 42-2 so that each of the side portions of the partition members 45-2 and 45-3 is pushed out to inside of the flow path 44-2 as is shown in FIG. 10B. Thus, the volume of the flow path 44-2 is decreased furthermore. The volume of the flow path 44-2 is rapidly decreased due to movements of the piezo-electric element 42-2 and the partition members 45-2 and 45-3 as has been described above so that the internal pressure in the flow path 44-2 is rapidly increased. Then, due to increasing of the internal pressure in the flow path 44-2, an ink drop is jetted through the orifice 49 corresponding to the flow path 44-2.

A piezo-electric element which contracts in a direction of a thickness thereof when a voltage is applied to it can be used. In normal state, the voltage is applied to the piezo-electric element and so the piezo-electric element contracts in a direction of the thickness and is pulling the partition members 45-2 and 45-3. When the applied voltage to the piezo-electric element is stopped, the piezo-electric element expands and returns to the initial state so that the volume of the flow path 44-2 is rapidly decreased and the internal pressure in the flow path 44-2 is rapidly increased. Due to the increasing of the internal pressure in the flow path 44-2, an ink drop is jetted through the orifice 49 corresponding to the flow path 44-2.

An expansion and contraction direction of the piezo-electric element is determined by selecting a polarization direction and a direction of an electric field suitably.

The piezo-electric element 42-2 is driven so that the shape of each of the partition members 45-2 and 45-3 is changed and the volume of the flow path 44-2 is changed. When this occurs, the volume of each of the flow path 44-1 and 44-3 which is adjacent to the flow path 44-2 changes a very little. Thus, almost no mutual interference between the two flow paths adjacent to each other exists so that it is possible to drive the two flow paths adjacent to each other at a same time.

Figure 11A:
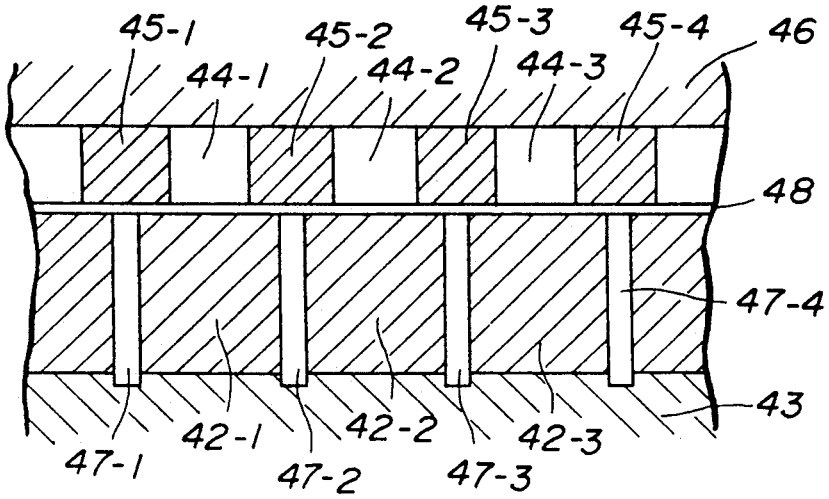
FIG. 11A through FIG. 11C are cross-sectional views showing other structures of the liquid jet recording head according to the present invention.
Figure 11B:
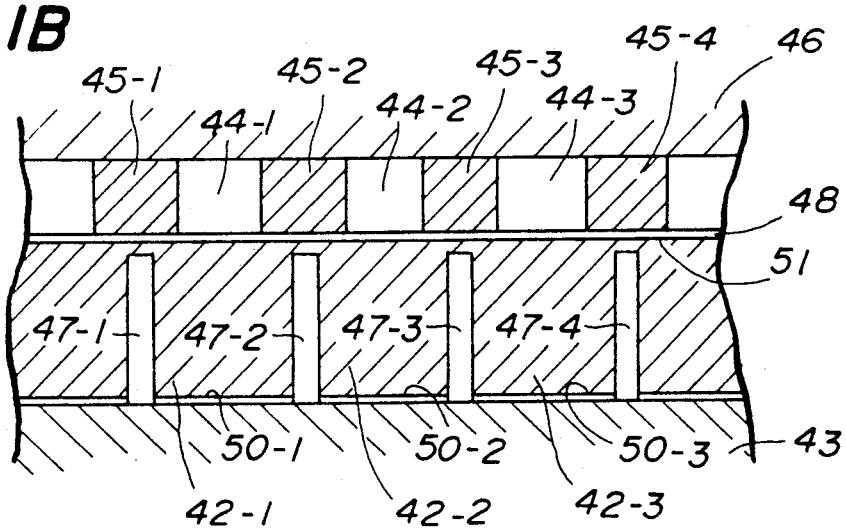
Figure 11C:
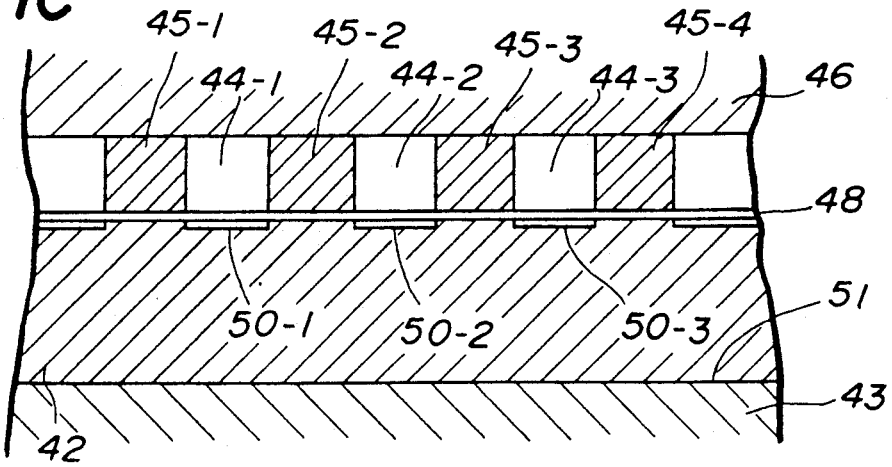

Each of FIG. 11A through FIG. 11C shows another structure of the recording head. In FIG. 11A, a plurality of grooves are formed on the base plate 43 and each of them is continuous with one of the grooves 47-1, 47-2, 47-3, . . . which is formed on the piezo-electric plate. In FIG. 11B, the recording head has the piezo-electric plate in which processing to form the grooves 47-1, 47-2, 47-3, . . . has been performed from a surface contacting the base plate 43. In FIG. 11C, the piezo-electric plate has no groove to form the piezo-electric element. In this case, each of the piezo-electric element is formed at a portion corresponding to one of the drive electrodes 50-1, 50-2, 50-3, . . . .

A description will now be given of a example of the processing method of the recording head with respect to FIG. 12A through FIG. 12F.

Figure 12A:
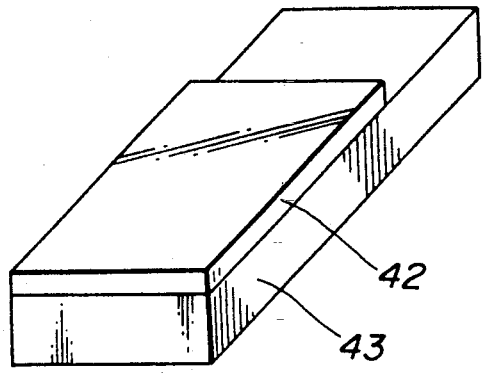
FIG. 12A through FIG. 12F show machining processes of the liquid jet recording head according to the present invention.
Figure 12B:
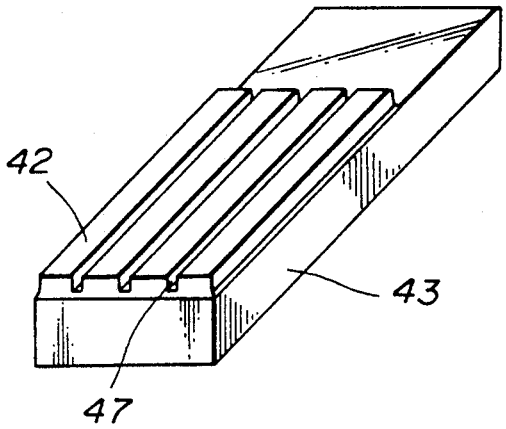

FIG. 12A, the piezo-electric plate 42 is adhered to the base plate 43. The piezo-electric plate 42 has an arbitrary thickness between 0.1 mm and 0.5 mm. In FIG. 12B, a plurality of grooves 47 are formed in parallel with each other on the piezo-electric plate 42 by using arbitrary processing which has been know. It is possible for the processing to use a cutting machining, an etching processing, a laser beam machining, an electric discharge machining, an ultrasonic machining or the like. In addition, arbitrary combination of some of these machining and processing can be used. A piezo-electric element is formed between two of the grooves 47 which is adjacent to each other. It is necessary that the piezo-electric elements are substantially isolated from each other by the grooves 47. It is possible that the adjacent piezo-electric elements are partially connected each other as is shown in FIGS. 10A and 10B. It is also possible that the groove continuous with the groove formed on the piezo-electric plate is formed on the base plate 43 as is shown in FIG. 11A. A metal layer is formed on each surface of a lower surface and an upper surface of the piezo-electric plate. Then, the grooves 47 are formed on the upper surface so that the metal layer formed on the upper surface is divided into metal parts. Each of the metal parts forms the drive electrode of the piezo-electric element. The metal layer formed on the lower surface of the piezo-electric plate forms the common electrode of the piezo-electric elements. In the case of that the recording head has the structure as is shown in FIG. 11A, the base plate 43 is made of a conductor such as metal, silicon or the like. Then, the base plate 43 forms the common electrode itself.

Figure 12C:
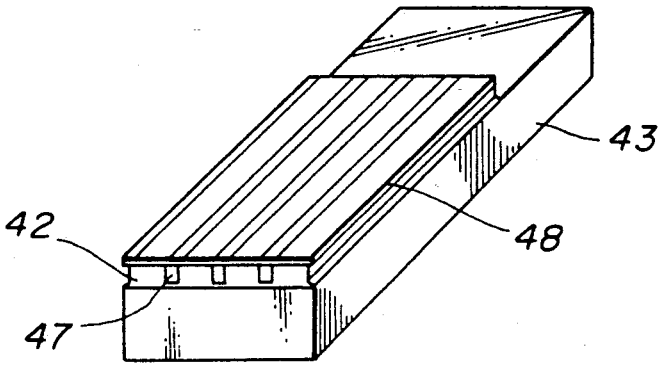

FIG. 12C, the connection layer 48 to connect the partition members to piezo-electric elements 42 is provided on the piezo-electric elements 42. The connection layer 48 is formed by using a method such as a spinner-coat method, dip-coat method, roller-coat method or the like, which has been known. Arbitrary liquid-type adhesive is applied to the piezo-electric elements 42 and the liquid-type adhesive becomes semi-curing state so the connection layer 48 is formed on the piezo-electric elements 42. The adhesive is not limited to a specific one among the adhesives which present predetermined adhesive strength. It is desired to use a photo-curing resin adhesive in that it is easy to handle for use. It is possible to use a laminated film of a dry film photoresist as the connection layer 48. In this case, the connection layer 48 has a function which protects the piezo-electric elements 42. In addition, another protection layer can be formed on the piezo-electric elements 42 at need. A suitable surface treating and a suitable insulation treating are performed on the piezo-electric elements so that it is possible to eliminate the connection layer 48.

Figure 12D:
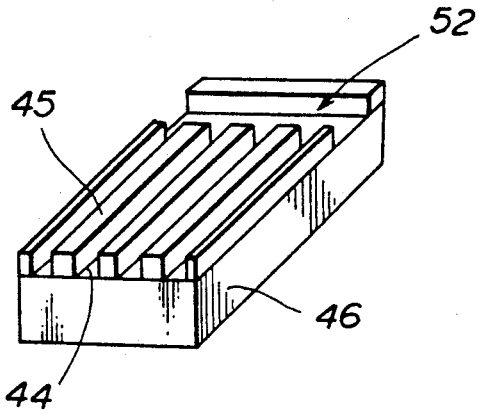

In FIG. 12D, it is possible to form the partition members 45 by forming grooves on a member as in the same case of the piezo-electric elements 42. In addition, it is easily possible to form a plurality of partition members 45 on the upper plate 46 by using a photo-sensitive resin such as a dry film photoresist or the like.

In the process of forming the partition members 45 by using the photo-sensitive resin, first, a photo mask having predetermined patterns corresponding to the partition members 45 is placed on the dry film photo-resist, then, the dry film photo-resist is exposed. The exposed part of the dry film photo-resist is dissolved by a developing solution and is eliminated so that the partition members 45 is formed. The flow path 44 is formed between adjacent two of the partition members 45. In the process described above, if a photo mask corresponding to a common liquid chamber is used, it is possible to form the common liquid chamber 52 at a same time. A liquid-type photo sensitive composition material can be also used in the process. It is also possible to form the partition members 45 and the common liquid chamber integrally with the upper plate 46 by a resin moulding process or the like. It is desired to form the partition members 45 by using the photo-sensitive resin in that the process control is easy.

Figure 12E:
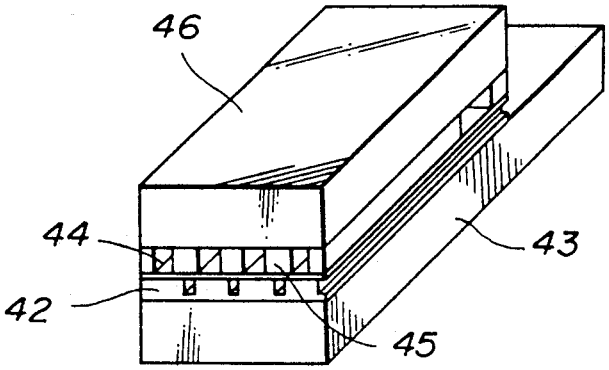

In FIG. 12E, the upper plate 46 having the partition members 45 is connected to the base plate having the piezo-electric elements 42 and connection layer 48. It is possible that the connection layer 48 made of the dry film and the partition members 45 made of the dry film are mutually connected by thermocompression bonding. It is also effective to use both of the heat curing and the curing by ultraviolet. Due to the connection of the partition members 45 and connection layer 48, the flow paths 44 is completely isolated from each other.

Figure 12F:
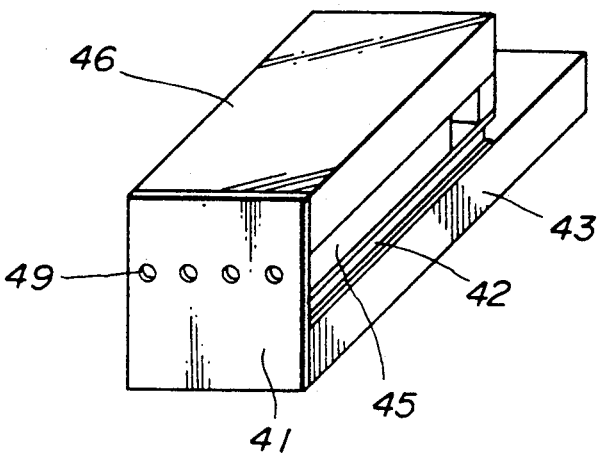

In FIG. 12F, the nozzle plate 41 having the orifices is provided to the front end of a structure having the base plate 43, piezo-electric elements 42, the partition members 45 and the upper plate 46. Due to the expansion and contraction of the piezo-electric elements 42 and of the partition members 45, the stress is generated at the connection part of the structure and the nozzle plate 41. Thus, it is desired that a connection layer or a buffer member be provided, to soften the stress, between the structure and the nozzle plate 41.

It is desired that the piezo-electric elements 42 be substantially separated from each other. However, it is also possible to isolate the piezo-electric elements 42 from each other by forming the drive electrodes which are separated from each other on the piezo-electric plate. It is also possible to use the layer-type piezo-electric plate. Due to this layer-type piezo-electric plate, a recording head which can be driven by low voltage is given.

In the second embodiment as has been described above, one piezo-electric element is provided correspondingly one flow path. It is possible to provide two piezo-electric elements correspondingly one flow path so that the flow path sandwiched between the two piezo-electric elements. In this case, the volume of the flow path is easily changed so that ink drops are certainly jetted through the orifice. It is also possible to provide the nozzle plate 41 on the upper plate 46. In addition, if the orifice is formed integrally with the partition member 45, it is not necessary to use the nozzle plate 41.

Accordingly to the present invention, each of the piezo-electric elements gives the vibration only to the corresponding flow path so that it is possible to operate without warping of the flow path plate. In addition, according to the present invention, the partition wall of the flow path has the elasticity member so that it is possible to obtain a sufficient changing of the volume in the flow path. Thus, liquid drops are certainly jetted through the orifices.

The present invention is not limited to the aforementioned embodiments, and variations and modifications may be made without departing from the scope of the claimed invention.

What is claimed is:

1. A liquid jet recording head as claimed in claim 1 wherein said elasticity member has a modulus of elasticity between 0.01 $Kg/mm^2$ and 300 $Kg/mm^2$.

2. A liquid jet recording head as claimed in claim 1 wherein said piezo-electric member is a layer-type piezo-electric member.

3. A liquid jet recording head as claimed in claim 1 further comprising a driver unit driving said piezo-electric elements.

4. A liquid jet recording head as claimed in claim 3 wherein said driver unit is provided on said piezo-electric member.

5. A liquid jet recording head as claimed in claim 3 wherein said flow path member has a extension portion and said driver unit is provide on said extension portion, said extension portion having lines electrically connecting each of said piezo-electric elements to said drive unit.

6. A liquid jet recording head comprising:

a flow path member having a first surface and second surface opposite to said first surface, said first surface having a plurality of first flow paths which are arranged in parallel with each other, each of said plurality of first flow paths being isolated from an adjacent first flow path by a partition wall and having a first opening surface which opens on said first surface, said second surface having a plurality of second flow paths which are arranged in parallel with each other, each of said plurality of second flow paths being isolated from an adjacent second flow path by a partition wall and having a second opening surface which opens on said second surface, each of said first flow paths being opposite to a portion which is sandwiched by adjacent two of said second flow paths;

a first piezo-electric member having a plurality of first grooves which are formed on said first piezo-electric member and are arranged in parallel with each other, and first piezo-electric elements, each of said first piezo-electric elements being formed between adjacent two first grooves of said plurality of first grooves and having a width which is less than or equal to a width of said first opening surface of each of said plurality of first flow paths, said first piezo-electric member being connected to said first surface of said flow path member so that each of said first piezo-electric elements faces the first opening surface of one of said plurality of first flow paths;

a second piezo-electric member having a plurality of second grooves which are formed on said second piezo-electric member and are arranged in parallel with each other, and second piezo-electric elements, each of said second piezo-electric elements being formed between adjacent two second grooves of said plurality of second grooves and having a width which is less than or equal to a width of said second opening surface of each of said plurality of second flow paths, said second piezo-electric member being connected to said second surface of said flow path member so that each of said second piezo-electric elements faces the second opening surface of one of said plurality of second flow paths;

an elasticity member being provided in each of said first grooves formed on said first piezo-electric member and in each of said second grooves formed on said second piezo-electric member;

a liquid guide mechanism guiding, to each of said first flow paths and to each of said second flow paths, liquid which is supplied by an external liquid supplying mechanism; and first jet orifices, each of said first jet orifices being provided at an end portion of one of said first flow paths;

second jet orifices, each of said second jet orifices being provided at an end of one of said second flow paths; and wherein liquid in each of said first flow paths is jetted, as a liquid drop, through each of said first jet orifices due to a vibration of each of said first piezo-electric elements in a direction perpendicular to said first flow paths, and liquid in each of said second flow paths is jetted, as a liquid drop, through each of said second jet orifices due to a vibration of each of said second piezo-electric elements in a direction perpendicular to said second flow paths.

7. A liquid jet recording head as claimed in claim 6 wherein each of said first piezo-electric member and said second piezo-electric member is a layer-type piezo-electric member.

8. A liquid jet recording head as claimed in claim 6 wherein said elasticity member has a modulus of elasticity between 0.01 $Kg/mm^2$ and 300 $Kg/mm^2$.

9. A liquid jet recording head as claimed in claim 6 wherein said liquid guide mechanism having a back plate forming a common path connected to said first flow paths and said second flow paths.

10. A liquid jet recording head as claimed in claim 6 further comprising a first driver unit driving said first piezo-electric elements and a second driver unit driving said second piezo-electric elements.

11. A liquid jet recording head as claimed in claim 9 further comprising a driver unit driving said first piezo-electric elements and said second piezo-electric elements.

12. A liquid jet recording head as claimed in claim 11 wherein said driver unit is provided on said back plate and said back plate has holes and lines through said holes electrically connecting said first piezo-electric elements and said second piezo-electric elements to said drive unit.

13. A liquid jet recording head comprising:

a first flow path member having a plurality of first flow paths which are arranged in parallel with each other, each of said plurality of first flow paths being isolated from an adjacent first flow path by a partition wall and having a first opening surface which opens on said first flow path member;

a second flow path member having plurality of second flow paths which are arranged in parallel with each other, each of said plurality of second flow paths being isolated from an adjacent second flow path by a partition wall and having a second opening surface which opens on said second flow path member, each of said first flow paths being opposite to a portion which is sandwiched adjacent two of said second flow paths;

a piezo-electric member having a first outer layer and a second outer layer opposite to said first outer layer, said first outer layer having a plurality of first grooves which are formed on said first outer layer and are arranged in parallel with each other, and first piezo-electric elements, each of said first piezo-electric elements being formed between adjacent two first grooves of said plurality of said first grooves and having a width which is less than or equal to a width of said first opening surface of each of said plurality of first flow paths, said first outer layer being connected to said first flow path member so that each of said first piezo-electric elements faces the first opening surface of one of said plurality of first flow paths, and said second outer layer having a plurality of second grooves which are formed on said second outer layer and are arranged in parallel with each other, and second piezo-electric elements, each of said second piezo-electric elements being formed between adjacent two second grooves of said plurality of second grooves and having a width which is less than or equal to a width of said second opening surface of each of said plurality of second flow paths, said second outer layer being connected to said second flow path member so that each of said second piezo-electric elements faces the second opening surface of one of said plurality of second flow paths;

an elasticity member being provided in each of said first grooves formed on said first outer layer of said piezo-electric member and in each of said second grooves formed on said second outer layer of said piezo-electric member;

a liquid guide mechanism guiding, to each of said first flow paths and to each of said second flow paths, liquid which is supplied by an external liquid supplying mechanism;

first jet orifices, each of said first jet orifices being provided at an end portion of one of said first flow paths; and second jet orifices, each of said second jet orifices being provided at an end of one of said second flow paths;

wherein liquid in each of said first flow paths is jetted, as a liquid drop, through each of said first jet orifices due to a vibration of each of said first piezo-electric elements in a direction perpendicular to said first flow paths, and liquid in each of said second flow paths is jetted, as a liquid drop, through each of said second jet orifices due to a vibration of each of said second piezo-electric elements in a direction perpendicular to said second flow paths.

14. A liquid jet recording head as claimed in claim 13 wherein said piezo-electric member is a layer-type piezo-electric member.

15. A liquid jet recording head as claimed in claim 13 wherein said elasticity member has a modulus of elasticity between 0.01 $Kg/mm^2$ and 300 $Kg/mm^2$.

16. A liquid jet recording head as claimed in claim 13 further comprising a driver unit driving said first piezo-electric elements and said second piezo-electric elements.

17. A liquid jet recording head as claimed in claim 16 further comprising a back plate provided on an end of said piezo-electric member, wherein said driver unit is provided on the back plate and said back plate has holes and lines through said holes electrically connecting said first piezo-electric elements and said second piezo-electric elements to said drive unit.

18. A liquid jet recording head comprising:

a flow path member having a plurality of flow paths which are parallel to each other, each of said plurality of flow paths being isolated from an adjacent flow path by a partition wall and having an opening surface which opens on said flow path member, said partition wall having an elasticity member;

an piezo-electric member having a plurality of piezo-electric elements which are arranged in parallel with each other, each of said piezo-electric elements having a width which is greater than a width of said opening surface of each of said plurality of flow paths, said piezo-electric member being connected to said flow path member so that each of said piezo-electric elements faces one of said plurality of flow paths;

liquid guide mechanism guiding, to each of said plurality of flow paths, liquid which is supplied by an external liquid supplying mechanism; and jet orifices, each of said jet orifices being provided to an end portion of one of said plurality of flow paths;

wherein liquid in each of said plurality of flow paths is jetted, as a liquid drop, through each of said jet orifices due to a vibration of each of said piezo-electric elements in the perpendicular direction to each of said plurality of flow paths.

19. A liquid jet recording head as claimed in claim 18 wherein said piezo-electric member is a layer-type piezo-electric member.

20. A liquid jet recording head as claimed in claim 18 wherein said piezo-electric member has a plurality of grooves which are formed on said piezo-electric member and are arranged in parallel with each other, and each of said piezo-electric elements is formed between adjacent two grooves of said plurality of grooves.

21. A liquid jet recording head as claimed in claim 18 wherein each of said piezo-electric elements is substantially isolated from an adjacent piezo-electric element by using a drive electrode.

* * * * *